US008638040B2

(12) United States Patent
Zudrell-Koch et al.

(10) Patent No.: US 8,638,040 B2
(45) Date of Patent: Jan. 28, 2014

(54) ELECTRONIC BALLAST OR OPERATING DEVICE FOR ILLUMINATION MEANS HAVING PROGRAMMABLE OR CONFIGURABLE CONTROL UNIT

(75) Inventors: Stefan Zudrell-Koch, Dornbirn (AT); Kai Arbinger, Hard (AT)

(73) Assignee: TridonicAtco GmbH & Co. KG, Dornbirn (AT)

( * ) Notice: Subject to any disclaimer, the term of this patent is extended or adjusted under 35 U.S.C. 154(b) by 956 days.

(21) Appl. No.: 10/598,484

(22) PCT Filed: Feb. 24, 2005

(86) PCT No.: PCT/EP2005/001966

§ 371 (c)(1),
(2), (4) Date: Jun. 11, 2007

(87) PCT Pub. No.: WO2005/084085

PCT Pub. Date: Sep. 9, 2005

(65) Prior Publication Data

US 2008/0036395 A1 Feb. 14, 2008

(30) Foreign Application Priority Data

Mar. 1, 2004 (DE) ..... 10 2004 009 993

(51) Int. Cl.
*G05F 1/00* (2006.01)

(52) U.S. Cl.
USPC ..... 315/291

(58) Field of Classification Search
USPC ..... 315/307, 291, 244, 224
See application file for complete search history.

(56) References Cited

U.S. PATENT DOCUMENTS

| | | | | |
|---|---|---|---|---|
| 4,523,128 | A | 6/1985 | Stamm et al. | 315/291 |
| 4,914,356 | A * | 4/1990 | Cockram | 315/307 |
| 5,274,208 | A * | 12/1993 | Noda | 219/715 |
| 5,471,119 | A | 11/1995 | Ranganath et al. | 315/360 |
| 6,121,695 | A * | 9/2000 | Loh | 307/64 |
| 6,304,043 | B1 | 10/2001 | Klostermeier | 315/360 |
| 6,426,599 | B1 * | 7/2002 | Leeb | 315/224 |
| 6,548,963 | B2 * | 4/2003 | Van Casteren et al. | 315/209 R |
| 6,686,705 | B2 * | 2/2004 | Nerone et al. | 315/291 |

(Continued)

FOREIGN PATENT DOCUMENTS

| | | | |
|---|---|---|---|
| DE | 44 13 569 A1 | 11/1995 | G06F 1/32 |
| DE | 44 38 901 A1 | 5/1996 | H02J 13/00 |

(Continued)

*Primary Examiner* — Minh D A
(74) *Attorney, Agent, or Firm* — Fitzpatrick, Cella, Harper & Scinto

(57) ABSTRACT

In the case of an electronic ballast (1) for operating a lamp (10) or an operating device for illumination means, having mains terminals (5) for connecting the ballast (1) or operating device to a current supply, output terminals (6) for connecting a lamp or light source to the ballast (1) or operating device and a control unit (4) for controlling and/or regulating an operating voltage delivered to the lamp (LA) or light source via the output terminals (6), external control information (Vprog) for programming or configuring the operating behavior of the operating device is delivered to the control unit (4) via a programming input, and stored in a memory (4*a*) associated with the control unit (4). In accordance with the invention, the programming input is formed by means of the mains terminals (5) and/or the output terminals (6) of the ballast (1) or of the operating device (2), which are connected internally with the control unit (4).

26 Claims, 1 Drawing Sheet

(56) References Cited

U.S. PATENT DOCUMENTS

| | | | | |
|---|---|---|---|---|
| 6,819,059 | B2 * | 11/2004 | Block et al. | 315/241 S |
| 6,963,178 | B1 * | 11/2005 | Lev et al. | 315/307 |
| 2002/0145886 | A1 | 10/2002 | Stevens | 363/16 |
| 2003/0222603 | A1 | 12/2003 | Mogilner et al. | 315/294 |

FOREIGN PATENT DOCUMENTS

| | | | | |
|---|---|---|---|---|
| EP | 1 385 359 | A | 1/2004 | H05B 37/02 |
| FR | 2 854 002 | A | 10/2004 | H02J 13/00 |
| WO | WO 00/35252 | A | 6/2000 | H05B 37/02 |

* cited by examiner

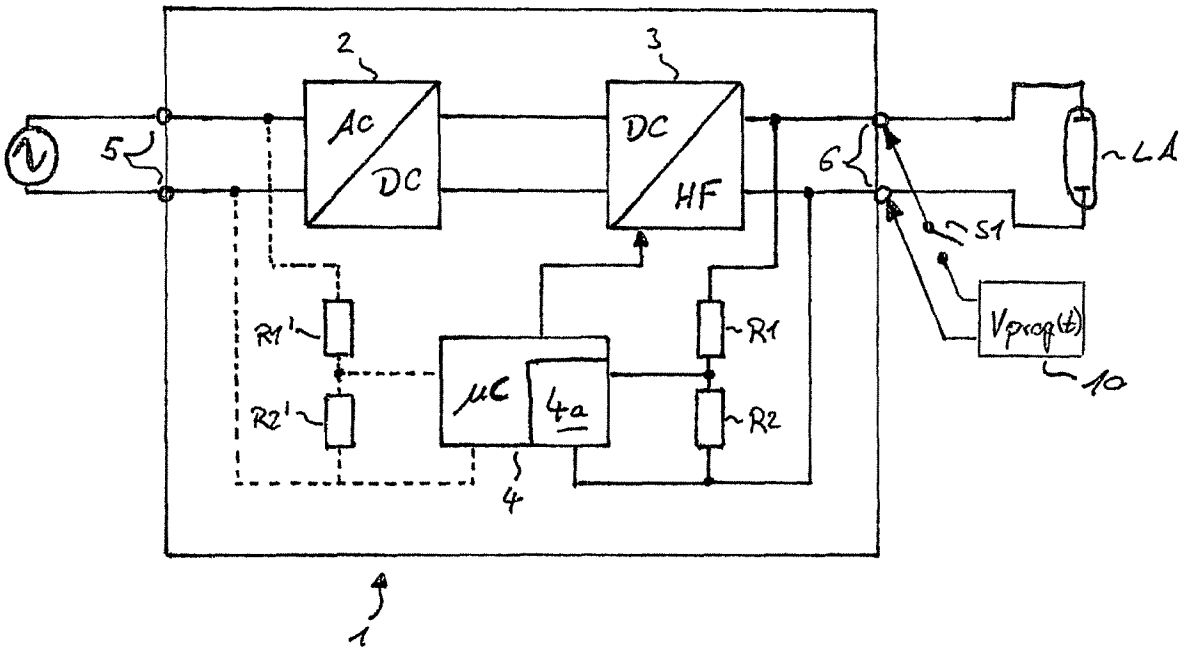
LA
10
Vprog(t)
S1
6
3
DC
HF
R1
R2
4a
μC
4
2
AC
DC
R1'
R2'
1
5

ELECTRONIC BALLAST OR OPERATING DEVICE FOR ILLUMINATION MEANS HAVING PROGRAMMABLE OR CONFIGURABLE CONTROL UNIT

FIELD

The present invention relates to the field of operating devices for illumination means, wherein external control information for programming or configuring the behavior of the electronic ballast or operating device can be delivered to a control unit, and can be stored in a memory associated with the control unit.

BACKGROUND

Electronic ballasts (EVGs) for operating lamps, in particular gas discharge lamps, are already well known. Ballasts of the latest generation are thereby not only capable of precisely monitoring the operating behavior of a lamp to be operated and ensuring a fault-free lamp operation, but beyond this also have a data or communication connection, via which they can communicate with other ballasts or with central control devices. Through this there is for example the possibility to send to the ballast brightness commands for the controlled lamps. Beyond this, the sent data can also generally influence the operating behavior of the ballast, for example indicate the average power to be delivered to the gas discharge lamp or to determine the pre-heating duration before an ignition of the lamp.

Along with these ballasts just described, which are configured for extensive data communication, there are however often put to use also simply configured ballasts which are exclusively provided for operating the associated lamp in accordance with a predetermined scheme. The operating behavior of these ballasts is already largely fixed during production and can subsequently not be influenced or only slightly influenced. In particular such ballasts are not configured to communicate, or at least to receive data, via corresponding data or communication connections with other participants of an illumination system or with a central control device.

In order, even with these more simple ballasts, to open up the possibility of being able to influence the operating behavior still at least to a certain degree at a later time point, that is after production, it is known to provide such ballasts with a configuration input. At this configuration input there can then be connected passive configuration elements such as e.g. resistances or the like, which through their physical characteristics influence a certain function of the ballast. For example it is known, through the size of an external resistance connected to the configuration input, to set the power which is delivered from the ballast to the lamp, or to determine the duration of the pre-heating phase before an ignition of the gas discharge lamp.

Through the arrangement of an additional configuration input, however, the outlay for production of the electronic ballast is in turn increased. Further, the possibilities for influencing the operating behavior of the ballast with the aid of such a configuration input are limited. Beyond this, it is to be considered that usually electronic ballasts are fully enclosed in a housing, which solely has the terminals for current supply of the ballast and the terminals for the lamp. With these very compact configurations, supplementary terminals or inputs are not provided, for which reason a subsequent influencing of the operating behavior is not possible.

SUMMARY

The problems referred to above relate not only to electronic ballasts for gas discharge lamps but general operating devices for illumination means. Also in the case of other illumination means such as e.g. incandescent lamps, halogen lamps or LEDs, it is often desired or even necessary to be able to subsequently influence the operating behavior of the device (or to be able to subsequently correct, centrally and without disassembly, a subsequently recognized failure in the software of the operating device). A particularly important application example is thereby the employment of LEDs or LED modules, since these light sources for realizing a precise color output must be calibrated after their production, which as a rule is effected through the transfer of appropriate configuration data.

Correspondingly, the object of the present invention is to indicate a new type of possibility of influencing the operating behavior of an electronic ballast or an operating device for illumination means. In particular the possibility is intended to be opened to deliver external control information for programming or configuring the operating behavior, in a manner which is as simple as possible to the control unit, associated with the operating device, without it being necessary for this to associate additional terminals or inputs.

This object is achieved by means of the features of the independent claims. The dependent claims further develop the central concept of the invention in particularly advantageous manner.

It is a concept of the present invention to use as programming inputs, via which the external control information can be delivered to a control unit arranged in the ballast or operating device, the main terminals for current supply of the ballast or operating device and/or the output terminals, which generally are provided for the purpose of delivering to a lamp an appropriate operating voltage, for which purpose the mains and output terminals are internally connected with the control unit. In accordance with the solution according to the invention there is thus needed no additional configuration input or data input, since the already present terminals of the ballast or operating device are employed for data reception. There arises through this in very simple manner the possibility of transmitting data to the control unit, which can be stored in a memory associated with the control unit, whereby the data then influences the operating behavior of the ballast or operating device, for example setting certain operating parameters or defining operational processes.

The internal connection between the mains terminals and/or output terminals serving as programming input with the control unit can for example be effected via connection lines which include a resistive voltage divider. Alternatively thereto, the connection could however also be effected magnetically, capacitatively, optically or by means of a wireless connection.

In accordance with a preferred configuration of the present invention there is involved in the case of the memory for storing the externally delivered control information a non-volatile memory. The control unit has at least a logic circuit, for example a microprocessor, which is connected with the memory.

The transfer of the control information is preferably effected in a time period in which the ballast or operating devices is inactive, insofar as the lamp is not supplied with current in this time period. After conclusion of the transfer of the control information the lamp can then be ignited in the usual manner and operated, whereby the operating behavior is determined by means of the previously delivered control information.

For transmitting the control information there is provided in accordance with the invention a programming device which is configured for the purpose of being connected to the mains terminal and/or output terminals of the ballast or operating device, in order to transfer the control information to the control unit arranged in the ballast or operating device. Preferably there is hereby involved a portable programming device, which can be taken by a user to the already installed ballast/operating devices.

The present invention correspondingly relates also to an illumination arrangement of larger scale, which has at least one luminaire with an electronic ballast for operation of a lamp or has a operating device for illumination means and a programming device, which is configured in the above-described manner for the purpose of transferring control information to the ballast or operating device and thereby influencing its operating behavior.

The subsequent transfer of control information is otherwise also of advantage since through this a lamp operating within a desired power window can be ensured. Often ballasts deviate, after their production, from the predetermined desired power, which is due to tolerances in the components used which are unavoidable. By means of a subsequent influencing for example of the intermediate circuit voltage or the operating frequency of the supply voltage delivered to the load circuit with the lamp, such component tolerances can be taken into account and deviations in the output power corrected. Particularly important in this context is also the subsequent calibration of semiconductor light sources such as e.g. LED modules, in order through this to ensure a precise color provision.

BRIEF DESCRIPTION OF THE DRAWING

Below, the invention will be described in more detail with reference to the accompanying drawings. The single FIG. 1 thereby shows as exemplary embodiment an electronic ballast configured in accordance with the invention for operating a gas discharge lamp. The ballast is thereby only an example for an illumination means operating device.

DETAILED DESCRIPTION

The ballast 1 in accordance with the invention is only reproduced schematically in FIG. 1 with the components significant for the lamp operation, since the present invention can fundamentally find employment with all kinds of electronic ballasts for operating lamps.

Illustrated components are a rectifier 2, connected with the input terminals 5 of the ballast 1, for rectifying the supply a.c. voltage present at the terminals 5, and an inverter 3 which transforms the d.c. voltage received from the rectifier 2 into a high frequency a.c. voltage and passes this on as output voltage to output terminals 6 of the ballast 1, at which in turn the lamp LA to be operated by the ballast 1 is connected. The further components, that are usually provided in electronic ballast, for example diverse elements for harmonics filtering or a smoothing circuit for transforming the rectified supply a.c. voltage into a d.c. voltage of particular level, are not illustrated, since they are already known in their function and for the present invention are not further of significance.

Further it is to be remarked that the present invention is also not restricted to employment in the case of electronic ballasts, but instead can be put to use in general with operating devices for arbitrary illumination means.

A significant component of the electronic ballast 1 with regard to the present invention is a control unit 4 to which commands can be delivered from the outside and which controls the operation of the operating device in accordance with available commands and desired values.

In the illustrated example, the control unit controls the inverter 3 and therewith the operating voltage for the lamp LA provided by the inverter 3. The control unit 4 for this purpose generates appropriate control information and transfers this to the inverter 3, which for example may have a half-bridge arrangement of two controllable switches. By means of an appropriate influencing of the switching frequencies the lamp—which may in particular be a gas discharge lamp—can be operated in desired manner, in particular initially preheated, ignited and supplied with a predetermined power.

Corresponding information which influences the behavior of the control unit 4, and thus of the ballast 1 overall, is contained in a memory 4*a*, which may be functionally connected with the control unit or—as illustrated—is a component of the control unit 4. This memory is preferably a non-volatile memory. The control unit 4 in turn contains preferably a microprocessor μC which can access the memory 4*a* and is responsible for the generation of the appropriate control signals for controlling the inverter 3.

It is to be noted that instead of the microprocessor μC, also other logical circuits can be put to use, which assume the necessary control tasks.

The operating behavior of the illustrated electronic ballast 1 can be altered or adapted in that the information contained in the memory 4*a* is altered or updated. To date it was known to provide for this purpose an additional control input at the ballast 1, which was connected with the control unit 4 or the memory 4*a* and via which then appropriate data could be transmitted to the control unit 4.

In accordance with the present invention, however, this additional input is now omitted. Instead, there are employed as programming input already present terminals of the ballast 1. In the illustrated exemplary embodiment in particular the output terminals 6 are used, which are connected via corresponding connection lines, and a voltage divider of two resistances R1 and R2, with the control unit 4. As is illustrated in FIG. 1, there is now the possibility of connecting to the output terminals 6 of the ballast 1 an external programming device 10, which transmits corresponding control information Vprog to the control device 4. The connection may thereby be effected directly at the output of the inverter 3; it would, however, also be conceivable to connect the programming device 10 to the coil contacts of the lamp LA.

Instead of the illustrated connection between the output terminals 6 and the control unit 4 by means of the illustrated connection lines and the resistive voltage divider it could also be provided to realize the connection by means of a magnetic, capacitative or optical coupling. Further it would also be conceivable to transfer internally the control information from the output terminals 6 to the control unit 4 by means of a radio connection.

The external programming device 10 is in particular configured to be portable and can be provided for the purpose of being connected to various ballasts of an illumination system, in order to configure or program the devices subsequently.

The control information transmitted from the external programming device 10 is stored in memory 4*a* of the control unit 4 and determines the operating behavior of the ballast 1. In particular the data may contain information with regard to the power delivered from the ballast 1 to the lamp LA. Thereby there is the possibility of externally predetermining a desired power of operating frequency at which the lamp LA is to be operated. Through this there arises in particular the possibility of subsequently compensating for component tolerances occurring during production of the ballast, and therewith ensuring that all lamps are operated at the necessary or optimal power. A further possibility consists, through the external control information, of influencing the pre-heating of the lamps or adapting the power to a newly connected lamp type.

A further important field of application of the present invention is in the control of LEDs or LED modules. Such semiconductor light sources must as a rule still be calibrated after their assembly, in order to ensure a light emission of the desired color. This is particularly important in the case of LEDs since the power with which the LEDs are operated has direct effect on the color of the emitted light. With an operating device for operation of LEDs in accordance with the present invention, there is now the possibility of carrying out the necessarily calibration in simple manner after production of the LED module. The necessary operating data can be transferred in accordance with the invention in simple manner to the operating device.

The substantial advantage of the solution in accordance with the invention consists in that no additional programming or configuration input is necessary, but instead the already present terminals of the operating device 1, which are usually configured as clamping contacts, are used.

Thereby there arises, alternatively or additionally to the illustrated configuration, in which the output terminals 6 of the ballast 1 are used as programming input, also the possibility—illustrated by broken lines—to use the input terminals 5, to which usually the supply a.c. voltage for the ballast 1 is applied, as programming input. The advantage of the illustrated variant, in which the output terminals 6 are employed as programming input, consists in that in this case the ballast 1 can at the same time be supplied with current in the normal manner.

If, in contrast, the input terminals 5 are used as programming input, it must be ensured that the current necessary for operation of the control unit and/or writing the memory 4*a* remains available. This could for example be effected in that the programming device in this case makes available the necessary energy. Also the use of an internal battery or accumulator battery in the ballast or operating device would be conceivable. In both cases the operating device could also be programmed in an offline condition or with mains switched off.

During the programming, the voltage supply need solely be sufficient to be able to operate the electronics (control unit, memory etc.). However in this programming mode, no power is given to the connected illumination means, so that the supply voltage may be lower than in the case of actual operation. The supply voltage may in programming mode also be a d.c. voltage instead of the a.c. voltage usual for illumination means operation.

It is also conceivable that the programming commands are modulated onto a supply voltage. In order to be able to exceed the narrow modulation level limits in the case of so-called power line technology, the control unit is functionally separated from the mains. For example it is generally ensured by means of filtering that also high modulation levels applied at the mains terminals cannot radiate back into the mains supply.

The transmission of the external control information is effected preferably in a period of time in which the lamp LA is not in operation. Only after the transfer has been completed can a lamp start then be carried out and the lamp operated under the conditions which were determined by means of the transferred control information.

The present invention thus permits, in simple manner, subsequently, i.e. after the production of the ballast or operating device, to have influence on its operating behavior. For this purpose no additional programming input need be provided, so that the ballast or operating device can be enclosed in the housing in the previously known manner. Thus, also for programming, for example in the case of a software alteration or fault correction, no disassembly of the device is necessary. If appropriate, software alterations can be carried out even centrally.

The invention claimed is:

1. An operating device for illumination means, comprising:

input terminals for connecting the operating device to a current supply mains;

output terminals for connecting the illumination means to the operating device; and a control unit for controlling and/or regulating an operation of the illumination means connected to the output terminals, wherein external control information (Vprog) for programming or configuring an operating behavior of the operating device is delivered to the control unit via a programming input, and is stored in a memory associated with the control unit, wherein the external control information includes at least one instruction executed by the control unit from an external programming device that is external to the operating device, wherein the external control information is transmitted from the external programming device to the control unit by connecting the external programming device to the input terminals or the output terminals, and wherein the programming input is formed using the input terminals and/or the output terminals of the operating device, and in a case where the input terminals are used in forming the programming input, the control unit is functionally separated from the current supply mains.

2. An operating device according to claim 1, wherein the input terminals and/or the output terminals used in forming the programming input are connected to the control unit via connection lines.

3. An operating device according to claim 2, wherein the connection lines include a voltage divider.

4. An operating device according to claim 1, wherein the input terminals and/or the output terminals used in forming the programming input are magnetically coupled with the control unit.

5. An operating device according to claim 1, wherein the input terminals and/or the output terminals used in forming the programming input are capacitatively coupled with the control unit.

6. An operating device according to claim 1, wherein the input terminals and/or the output terminals used in forming the programming input are optically coupled with the control unit.

7. An operating device according to claim 1, wherein the input terminals and/or the output terminals used in forming the programming input are coupled with the control unit via a radio connection.

8. An operating device according to claim 1, wherein the memory for storing the external control information is a non-volatile memory.

9. An operating device according to claim 8, wherein the control unit includes a logic circuit, having a microprocessor, connected to the memory.

10. An operating device according to claim 1, wherein the operating device is surrounded by a housing, and the input terminals and the output terminals comprise clamping contacts.

11. In combination, an operating device according to claim 1 and the external programming device, wherein the operating device is an electronic ballast and the illumination means is a lamp or light source, and the external programming device can be connected for the transfer of the external control information to coil contacts of the lamp or light source, or to the input terminals of the electronic ballast.

12. A combination including the operating device according to claim 11, further comprising an inverter for generation of a supply a.c. voltage for the lamp or light source, and wherein the external programming device is connected for the transfer of the external control information to the inverter.

13. A combination according to claim 11, wherein the external programming device during the transfer of the external control information (Vprog) forms a current supply source for the electronic ballast.

14. A combination according to claim 11, further comprising a battery for use as a current supply during the transfer of the external control information (Vprog).

15. A combination according to claim 1, wherein the external control information determines the output power of the operating device.

16. A programming device for programming or configuring an operating behavior of an electronic ballast for the operation of a lamp or an operating device for light sources, the electronic ballast or operating device having a control unit, wherein the programming device is constructed for mechanical and electrical connection with input terminals and/or output terminals of the electronic ballast or operating device, in order to transfer control information (Vprog) to the control unit of the electronic ballast or operating device, wherein the programming device is external to the electronic ballast or operating device and wherein the control information includes at least one instruction executed by the control unit, and wherein the external control information is transmitted from the programming device to the control unit by connecting the programming device to the input terminals or the output terminals, and when the input terminals are used for transfer of the control information, the control unit is functionally separated from a current supply mains.

17. A programming device according to claim 16, wherein the programming device is portable.

18. An illumination system, comprising:

at least one luminaire having an electronic ballast for operating a lamp or having an operating device for a light source, the electronic ballast or the operating device including:

input terminals for connecting the electronic ballast or operating device to a current supply mains, output terminals for connecting the lamp to the electronic ballast or connecting the light source to the operating device, and a control unit for control and/or regulation of an operating voltage delivered to the lamp or the light source via the output terminals; and a programming device for programming or configuring an operating behavior of the electronic ballast or operating device, wherein the programming device is constructed for connection with the input terminals and/or the output terminals of the electronic ballast or operating device, in order to transfer external control information (Vprog) to the control unit, wherein the programming device is external to the electronic ballast or the operating device and wherein the external control information includes at least one instruction executed by the control unit from the programming device, and wherein the external control information is transmitted from the programming device to the control unit by connecting the programming device to the input terminals or the output terminals, and when the input terminals are used in transferring the external control information, the control unit is functionally separated from the current supply mains.

19. A method of programming or configuring an operating behavior of an operating device for illumination means, wherein the operating device includes input terminals for connection of the operating device to a current supply mains, output terminals for connection of the illumination means to the operating device, and a control unit for the control and/or regulation of an operation of the illumination means connected to the output terminals, the method comprising the steps of:

forming a programming input using the input terminals and/or the output terminals of the operating device, the programming input constructed to transfer external control information (Vprog) to the control unit, wherein, when the input terminals are used in forming the programming input, the control unit is functionally separated from the current supply mains, wherein the external control information includes at least one instruction executed by the control unit, and wherein the external control information is transmitted from an external programming device to the control unit by connecting the external programming device to the input terminals or the output terminals;

connecting the external programming device to the formed programming input; and performing the programming or configuring by means of transferring the external control information (Vprog) via the programming input to the control unit.

20. A method according to claim 19, wherein the transfer of the external control information is effected in a configuration phase, in which the illumination means connected to the operating device is not operated.

21. A method according to claim 19, wherein the transfer of the external control information is effected in a phase in which the operating device is separated from the current supply mains or the current supply mains is switched off.

22. A method according to claim 19, wherein the external programming device, during the transfer of the external control information (Vprog), forms a current supply source for the operating device.

23. A method according to claim 19, wherein output power of the operating device is determined by the external control information.

24. A method according to claim 19, wherein during the programming, the operating device is supplied with a reduced supply voltage.

25. A method according to claim 19, wherein during the programming, the operating device is supplied with a d.c. supply voltage.

26. A method according to claim 19, wherein during the programming via the input terminals of the operating device, the operating device is functionally separated from the current supply mains in such a way that programming commands cannot be radiated back to the current supply mains.

* * * * *